US008924962B2

(12) United States Patent
Wang et al.

(10) Patent No.: US 8,924,962 B2
(45) Date of Patent: Dec. 30, 2014

(54) METHOD AND COMPUTER SYSTEM FOR SHARING GRAPHICS CARD AMONG MULTIPLE OPERATION SYSTEMS

(75) Inventors: Bibo Wang, Beijing (CN); Yongfeng Liu, Beijing (CN); Chunmei Liu, Beijing (CN); Jun Chen, Beijing (CN)

(73) Assignees: Beijing Lenovo Software Ltd., Beijing (CN); Lenovo (Beijing) Limited, Beijing (CN)

( * ) Notice: Subject to any disclaimer, the term of this patent is extended or adjusted under 35 U.S.C. 154(b) by 1299 days.

(21) Appl. No.: 12/343,768

(22) Filed: Dec. 24, 2008

(65) Prior Publication Data

US 2009/0172667 A1 Jul. 2, 2009

(30) Foreign Application Priority Data

Jan. 2, 2008 (CN) ..... 2008 1 0055938

(51) Int. Cl.
*G09G 5/36* (2006.01)

(52) U.S. Cl.
CPC ..... *G09G 5/363* (2013.01); *G09G 2340/12* (2013.01); *G09G 2360/06* (2013.01)
USPC ..... 718/1; 719/323

(58) Field of Classification Search
None
See application file for complete search history.

(56) References Cited

U.S. PATENT DOCUMENTS 4,833,596 A * 5/1989 Buckland et al. ..... 710/14
7,065,630 B1 6/2006 Ledebohm et al.
7,739,417 B2 6/2010 Liu et al.
2005/0193396 A1 9/2005 Stafford-Fraser et al.
2006/0005186 A1 1/2006 Neil
2006/0236094 A1 10/2006 Leung et al.
2007/0008324 A1 * 1/2007 Green ..... 345/501
2007/0052715 A1 3/2007 Levit-Gurevich et al.
2008/0005297 A1 1/2008 Kjos et al.
2008/0077917 A1 3/2008 Chen et al.
2008/0215770 A1 9/2008 Liu et al.

OTHER PUBLICATIONS

U.S. Appl. No. 11/860,939, filed Sep. 25, 2007. Inventors: Jun Chen, Yongfeng Liu, Chunmei Liu, Ke Ke.
Opferman, "Sharing Memory with the Virtual Machine," Nov. 1, 2005, http://www.ddj.com/cpp/184402033, Dr. Dobb's Online, 8 pages.

(Continued)

*Primary Examiner* — Andrew Caldwell
*Assistant Examiner* — John Lindlof
(74) *Attorney, Agent, or Firm* — Patterson Thuente Pedersen, P.A.

(57) ABSTRACT

The present invention provides a method and a computer system for sharing a graphics card among multiple Operation Systems (OSs). The method includes: detecting a first GOS to be displayed, the first GOS being a primary GOS or one of at least one secondary GOS; determining the kind of the first GOS, so that different display control register bank(s) and graphics card memory resources are allocated to the first GOS depending on whether it is a primary GOS or a secondary GOS; controlling the display control register bank(s) allocated to the first GOS to connect to a display output port; obtaining display contents based on the graphics card memory resources allocated to the first GOS; and displaying the display contents based on display mode parameters in the display control register bank(s) connected to the display output port. According to the present invention, it is possible to share the graphics card among the multiple OSs without modifying the drivers of the primary GOS.

13 Claims, 4 Drawing Sheets

(56) References Cited

OTHER PUBLICATIONS

King et al., "Operating System Support for Virtual Machines," Proceedings of the 2003 USENIX Technical Conference, 2003, 14 pages.

Sweeney, "Run multiple operating systems on a single PC with Virtual PC," TechRepublic, Jun. 9, 2003, http://articles.technrepublic.com.com/5100-10878_11-5035049.html, 14 pages.

U.S. Appl. No. 12/025,287, filed Feb. 4, 2008 inventors Liu et al.

* cited by examiner

METHOD AND COMPUTER SYSTEM FOR SHARING GRAPHICS CARD AMONG MULTIPLE OPERATION SYSTEMS

RELATED APPLICATION

The present application claims priority to Chinese Application No. 200810055938.8 filed Jan. 2, 2008, which is incorporated herein in its entirety by reference.

BACKGROUND OF THE INVENTION

1. Field of the Invention

The present invention relates to a technology of sharing a graphics card device, and more specifically, to a method for sharing a graphics card among multiple Operation Systems (OSs) and a computer system.

2. Description of Prior Art

By virtue of virtualization, it is possible to run multiple Guest Operation Systems (GOSs) on one same hardware platform. Display Contents from the multiple GOSs may be outputted to an external display device through one graphics card device so as to be displayed. That is, the multiple OSs perform their respective display by sharing the graphics card device.

According to a conventional technique in the virtualization field, the GOSs all use respective virtual graphics cards, and only one host OS uses the physical graphics card device. Such method has a disadvantage that the display performance of the GOSs is very poor, and many acceleration properties cannot by supported.

A recent technique provides a possibility for the GOSs to directly use the physical graphics card. However, only one GOS has the display output while the remaining OSs cannot have output through the graphics card.

To solve such problem, there have been proposed some techniques where the multiple GOSs all directly operate the physical graphics card device and they operate in a serial manner by means of some certain methods. Among them, a typical way is graphics card memory separation+register simulation. Specifically, the respective OSs use different resources of the graphics card memory, and each of them has a simulation register bank. When a certain OS needs to be displayed in the foreground, values of the registers for this OS are written into the real device, so as to display this OS.

However, the above method has the following disadvantage. Since the resources used by the respective OSs are completely separate from each other, it is necessary to modify device drivers for the graphics card of the respective OSs, and the amount of such modification is large. Further, since modern graphics card registers are very complex, it is very difficult to simulate all the registers. When an OS in the background is using the simulation registers, if the simulation is not proper, there will be an error in the graphics card, even causing the system down.

SUMMARY OF THE INVENTION

It is an object of the present invention to provide a method for sharing a graphics card among multiple Operation Systems (OSs) and a computer system, by which it is possible to share the graphics card among the multiple OSs without modifying device drivers of all the OSs.

To achieve the above object, according to an embodiment of the invention, there is provided a method for sharing a graphics card among multiple Operation Systems (OSs), the multiple OSs comprising a primary Guest Operation System (GOS) and at least one secondary GOS, the method comprising:

detecting a first GOS to be displayed, the first GOS being the primary GOS or one of the at least one secondary GOSs;

determining the kind of the first GOS, so that all display control register banks and all graphics card memory resources of the graphics card are allocated to the first GOS when the first GOS is the primary GOS, and one of the display control register banks and a part of the graphics card memory resources are allocated to the first GOS when the first GOS is the secondary GOS;

controlling the display control register bank(s) allocated to the first GOS to connect to a display output port;

obtaining display contents for the first GOS based on the graphics card memory resources allocated to the first GOS; and displaying the display contents based on display mode parameters in the display control register bank(s) connected to the display output port.

Further, according to another embodiment of the invention, there is provided a computer system, comprising:

a primary Guest Operation System (GOS) and at least one secondary GOS;

a virtual machine manager, in connection with the primary Guest Operation System (GOS) and the at least one secondary GOS;

a graphics card including at least two display control register banks, wherein the primary GOS is associated with all the display control register banks and all graphics card memory resources of the graphics card, while each of the at least one secondary GOS is associated with one of the display control register banks and a part of the graphics card memory resources of the graphics card;

a display output port; and a switching control unit for connecting a first GOS to the display output port upon it is detected that the first GOS is to be displayed, the first GOS being the primary GOS or one of the at least one secondary GOS, wherein, the first GOS is displayed through the display output port.

According to one or more embodiment of the present invention, there are the following advantages.

Only the drivers of the secondary GOSs need to be modified, while the drivers of the primary GOS do not need to be modified. Further, it is possible to achieve shared accesses to the graphics card with no registers or only a minor part of registers of the graphics card to be simulated. In addition, when the currently displayed GOS is to be switched, the display mode parameters, the display output setting parameters and the graphics card memory mapping relationship relevant to this GOS are saved so as to revert to the original display state in an easy and quick manner when switching back to this GOS. When the number of the display control register banks is smaller than the number of the GOSs, a GOS may simulate the graphics card to provide a virtual graphics card for other GOSs, so as to provide accesses to the graphics card for the other GOSs. When a secondary GOS is being displayed in the foreground, accesses to the graphics card memory resources relevant to this secondary GOS by other GOSs are intercepted and simulated, so as to provide a reliable display for the secondary GOS.

DETAILED DESCRIPTION

In a method for sharing a graphics card among multiple Operation Systems (OSs) and a computer system according to an embodiment of the present invention, it is possible for all the multiple virtual OSs to use the physical graphics card, instead of using a virtual graphics card.

According to an embodiment of the present invention, Guest Operation Systems (GOSs) are divided into one primary GOS and at least one secondary GOS. The primary GOS uses all Display Pipes and graphics card memory resources of the graphics card, while the secondary GOS uses only one of the Display Pipes and a part of the graphics card memory resources of the graphics card, so as to share the physical graphics card among the multiple virtual GOSs. Here, the display pipe is a display control register bank in the graphics card, with information on display mode parameters stored therein. The display mode parameters comprise, but are not limited to, resolution, refreshing rate, color depth, or information on graphics card memory used by the display contents. In embodiments of the present invention, the graphics card comprises at least two display control register banks.

Hereinafter, various embodiments of the present invention are described in more detail with reference to the attached drawings.

The First Embodiment

Figure 1:
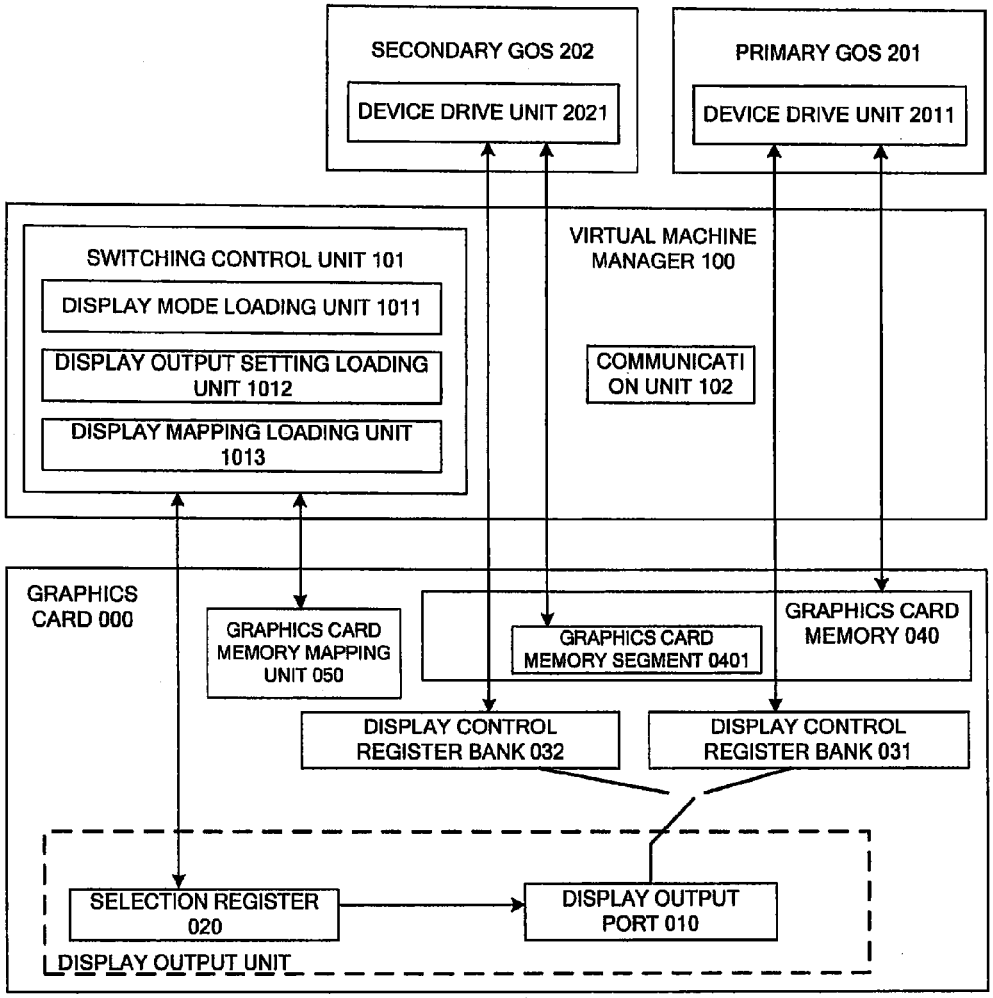
FIG. 1 is a schematic diagram showing a structure of a computer system according to a first embodiment of the present invention.

As shown in FIG. 1, a computer system according to the first embodiment of the present invention comprises a primary GOS 201, a secondary GOS 202, a virtual machine manager 100 and a graphics card 000. The primary GOS 201 comprises a device drive unit 2011, and the secondary GOS 202 comprises a device drive unit 2021. The primary GOS 201 and the secondary GOS 202 belong to a first class of GOSs which directly access the graphics card 000. The virtual machine manager 100 comprises a switching control unit 101 and a communication unit 102. The graphics card 000 comprises two display control register banks 031 and 032, and also a display output unit and a graphics card memory 040. Specifically, the display output unit comprises a display output port 010 and a selection register 020. The respective GOSs run on the virtual machine manager 100, and the communication unit 102 provides communications between the respective GOSs and between the GOSs and hardware devices (for example, the graphics card).

Here, the primary GOS 201 can use all resources of the graphics card, including all the display control register banks and all graphics card memory resources. Therefore, for the primary GOS 201, there is no need to modify its device drivers for the graphics card. The secondary GOS 202 uses only one display control register bank of the graphics card and a part of the graphics card memory resources. Therefore, it is necessary for the secondary GOS 202 to modify its device drivers for the graphics card, and to allocate corresponding display control register bank and graphics card memory resources thereto.

The device drive unit 2011 saves configuration information about all the display control register banks and all the graphics card memory resources of the graphics card allocated to the pertaining GOS, and provides accesses to the graphics card for the pertaining GOS based on the configuration information. Here, the primary GOS 201 can use the display control register banks 031 and 032 as well as all the resources of the graphics card memory 040.

The device drive unit 2021 saves configuration information about the one display control register bank and the part of the graphics card memory resources of the graphics card allocated to the pertaining GOS, and provides accesses to the graphics card for the pertaining GOS based on the configuration information. Here, the secondary GOS 202 can only use the display control register bank 032 and a memory segment 0401 of the graphics card memory 040. It is preferred to select a segment of the graphics card memory 040 which is less used by the primary GOS 201 and, even used by the primary GOS 201, is used only for storing display data as the memory segment 0401.

The switching control unit 101 saves all or part of the configuration information about the graphics card memory resources and the display control register banks allocated to the respective GOSs, and determines the information of the graphics card memory resources and the display control register bank(s) for a GOS to be displayed. Here, the switching control unit 101 may be provided in the virtual machine manager 100, or in the GOSs.

The display output unit obtains, based on the information of the graphics card memory resources and the display control register bank(s) determined by the switching control unit 101, display contents and display mode parameters for the GOS to be displayed, and carries out display output on the display contents based on the display mode parameters.

Specifically, the display output unit comprises the selection register 020 and the display output port 010.

The selection register 020 saves the information of the display control register bank(s) determined by the switching control unit 101.

The display output port 010 obtains the display contents for the GOS to be displayed based on the graphics card memory resources determined by the switching control unit 101, obtains the corresponding display mode parameters based on the information of the display control register bank(s) stored in the selection register 020, and carries out display output on the display contents based on the display mode parameters.

According to the above configuration, the respective GOSs access the display control register banks and the graphics card memory resources allocated thereto respectively through the respective device drive units. When a certain GOS is to be displayed in the foreground, display output for the GOS is performed based on the display mode parameters in the display control register bank(s) for the GOS.

Since a user may have configured the display mode parameters and/or display output setting parameters for the currently displayed GOS, such configuration may be saved when the currently displayed GOS (for example, the primary GOS 201) is switched to another GOS (for example, the secondary GOS 202). Thus, when switching back to the previously displayed GOS (for example, the primary GOS 201), it is possible to revert to the previous display state in an easy and quick manner by loading the saved configuration. Here, the display output setting parameters refer to a current configuration for the display output port, and may comprise, but not be limited to, display output port Enable/Disable setting, cyclic redundant code check (CRC) setting for the display output port, synchronization setting and the like.

To achieve the above object, as shown in FIG. 1, there may be provided a display mode loading unit 1011 and a display output setting loading unit 1012 in the switching control unit 101.

The display mode loading unit 1011 saves the display mode parameters in the display control register bank(s) for the currently displayed GOS, and loads pre-stored display mode parameters for the GOS to be displayed.

The display output setting loading unit 1012 saves the display output setting parameters corresponding to the currently displayed GOS, and loads pre-stored display output setting parameters corresponding to the GOS.

Herein, if the graphics card 000 maps the resources of the graphics card memory to a physical memory by means of a graphics card memory mapping relationship table, then as shown in FIG. 1, the graphics card may further comprise a graphics card memory mapping unit 050, and the switching control unit 101 may further comprise a graphics card memory mapping loading unit 1013. The graphics card memory mapping unit 050 is controlled by the graphics card memory mapping loading unit 1013 to select the graphics card memory resources to be used by the GOS.

The graphics card memory mapping unit 050 saves the mapping relationship between the graphics card memory and the physical memory.

The graphics card memory mapping loading unit 1013 saves the current mapping relationship in the graphics card memory mapping unit 050, and loads the pre-stored mapping relationship corresponding to the GOS to be displayed into the graphics card memory mapping unit 050.

Herein, it is possible to select the graphics card memory resources to be used by the GOSs in another manner, for example, by modifying a shadow page table, an extended page table, or a nested page table for a GOS in the virtual machine manager 100.

Figure 2:
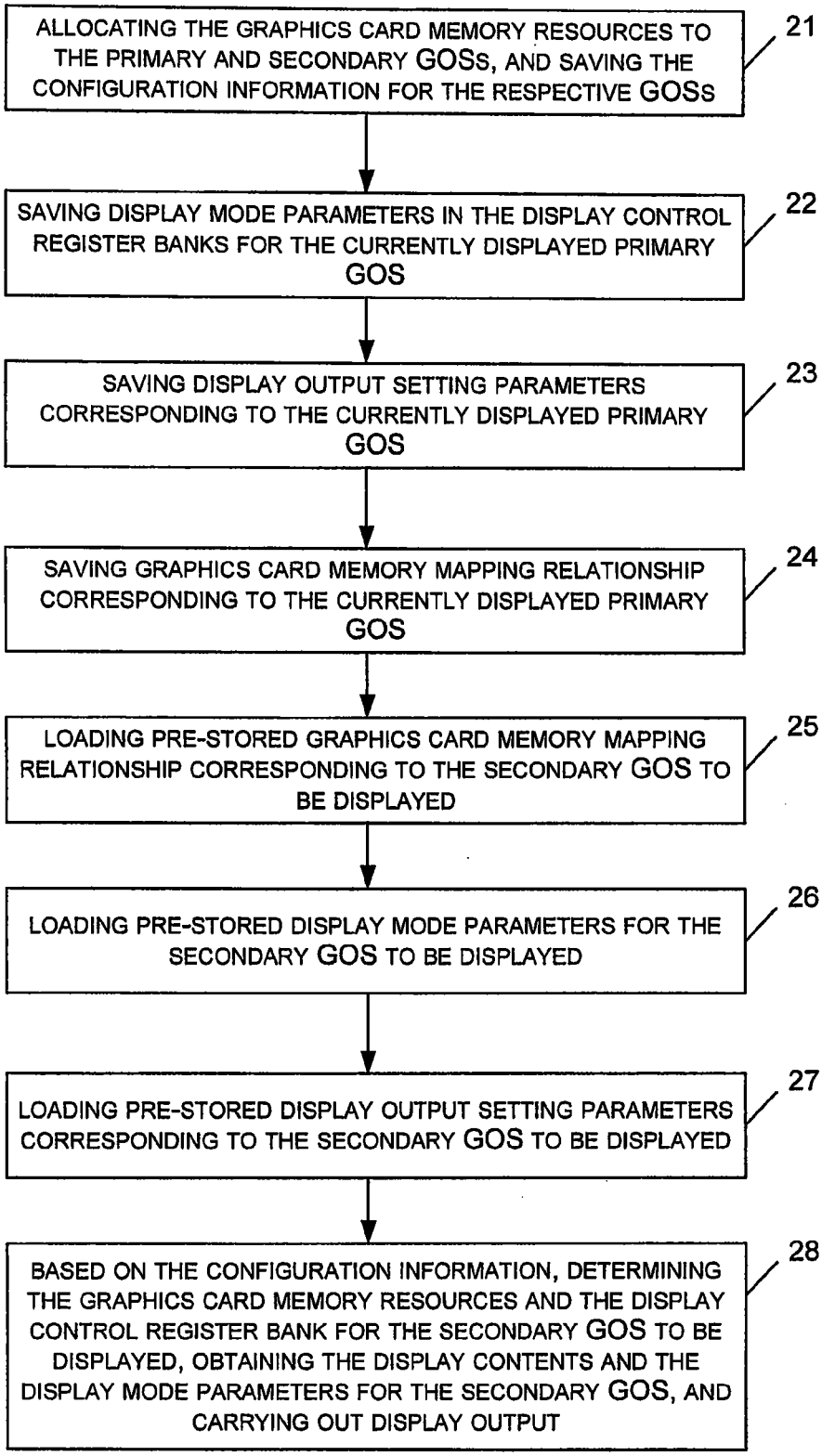
FIG. 2 is a flowchart illustrating a method for sharing a graphics card among multiple Operation Systems according to the first embodiment of the present invention.

Hereinafter, based on the computer system shown in FIG. 1, a method for sharing a graphics card among multiple OSs according to an embodiment of the present invention is described, in a case, for example, where the currently displayed GOS is to be switched from the primary GOS 201 to the secondary GOS 202. As shown in FIG. 2, the method comprises steps of:

Step 20: allocating all the display control register banks and all the graphics card memory resources of the graphics card 000 to the primary GOS 201 and allocating one of the display control register banks and a part of the graphics card memory resources to the secondary GOS 202 in advance, and saving all configuration information about the graphics card memory resources and the display control register banks for the respective GOSs in a correspondence table, wherein the respective GOSs access the graphics card based on the graphics card memory resources and the display control register bank(s) allocated thereto respectively;

Step 21: detecting that the currently displayed GOS is to be switched from the primary GOS 201 to the secondary GOS 202;

Step 22: saving the display mode parameters in the display control register banks for the primary GOS 201 which is currently displayed;

Step 23: saving the display output setting parameters corresponding to the primary GOS 201 which is currently displayed;

Step 24: saving the graphics card memory mapping relationship corresponding to the primary GOS 201 which is currently displayed;

Step 25: loading pre-stored graphics card memory mapping relationship corresponding to the secondary GOS 202 to be displayed;

Step 26: loading pre-stored display mode parameters for the secondary GOS 202 to be displayed;

Step 27: loading pre-stored display output setting parameters corresponding to the secondary GOS 202 to be displayed; and Step 28: calling the correspondence table to determine the information about the graphics card memory resources and the display control register bank for the secondary GOS 202 to be displayed, obtaining the display contents and the display mode parameters for the secondary GOS 202 based on the determined information about the graphics card memory resources and the display control register bank, and carrying out display output on the display contents based on the display mode parameters.

As can be seen from the above, in this embodiment, only the drivers of the secondary GOS need to be modified, while the drivers of the primary GOS do not need to be modified. Further, it is possible to achieve shared accesses to the graphics card with no registers or only a minor part of the registers of the graphics card to be simulated. In addition, when the currently displayed GOS is to be switched, the display mode parameters, the display output setting parameters and the graphics card memory mapping relationship relevant to this GOS are saved so as to revert to the original display state in an easy and quick manner when switching back to this GOS.

The Second Embodiment

The primary GOS can use all the resources of the graphics card. Therefore, when the secondary GOS is being displayed in the foreground and the primary GOS is running in the background, the primary GOS may access the graphics card resources which are currently used by the secondary GOS, interfering with the display of the secondary GOS. Therefore, in this embodiment, an interception module is added to intercept such access, in order to ensure the reliable display of the secondary GOS.

When the primary GOS is being displayed in the foreground, by modifying the drivers of the secondary GOS in advance, it is possible that the secondary GOS in the background does not update the contents in the graphics card memory or the display control register banks, so as to avoid destroying the display contents of the primary GOS.

Figure 3:
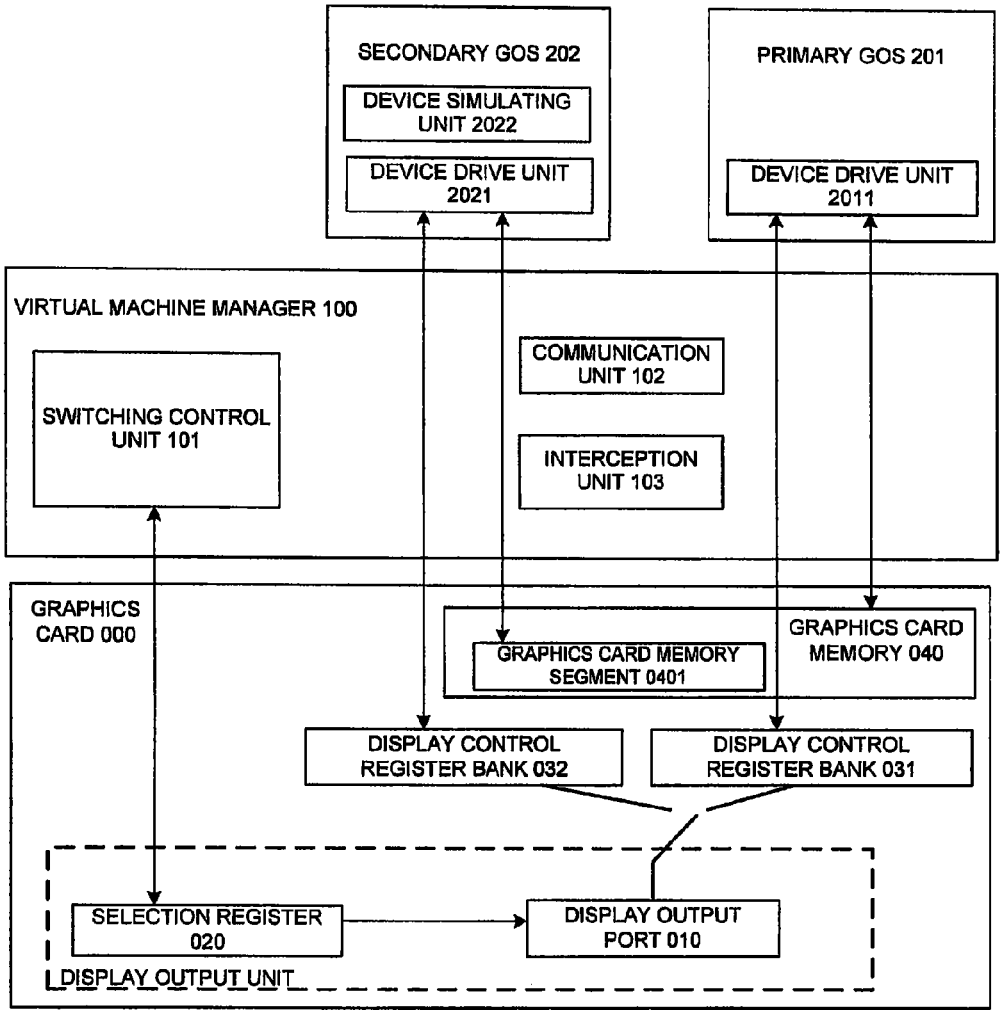
FIG. 3 is a schematic diagram showing a structure of a computer system according to a second embodiment of the present invention.

As shown in FIG. 3, in the computer system according to the present embodiment, the virtual machine manager 100 further comprises an interception unit 103, and the secondary GOS 202 further comprises a device simulating unit 2022.

The interception unit 103 intercepts accesses to the graphics card memory resources or the display control register bank for the secondary GOS 202 by other GOSs when the secondary GOS 202 is being displayed in the front end. The device simulating unit 2022 simulates the accesses to the graphics card, which are intercepted by the interception unit 103, for the other GOSs.

Based on the architecture of the computer system according to this embodiment, there is also provided a method for sharing a graphics card among OSs according to the embodiment. As compared with the method according to the first embodiment, the method according to the present embodiment further comprises a following step after Step 28 shown in FIG. 2:

Step 29: when the secondary GOS is running in the background, the secondary GOS stopping updating the graphics card memory and the display control register bank for this secondary GOS; and when the secondary GOS is being displayed in the foreground, intercepting accesses to the graphics card memory resources or the display control register bank for this secondary GOS by other GOSs and simulating the accesses for the other GOSs.

The Third Embodiment

The number of the display control register banks in the graphics card is limited. When the number of the OSs exceeds the number of the display control register banks, a GOS may simulate the graphics card to provide a virtual graphics card for other GOSs, so as to provide accesses to the graphics card for the other GOSs.

Figure 4:
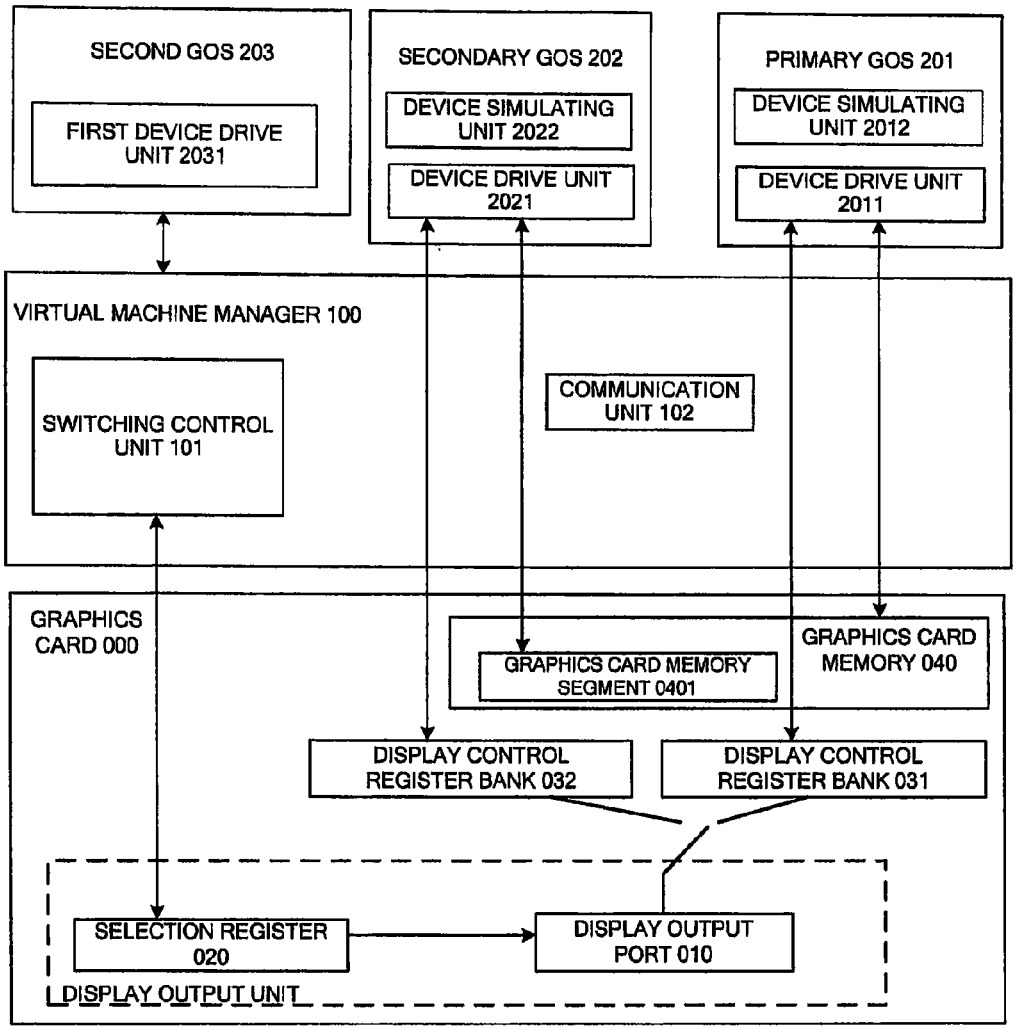
FIG. 4 is a schematic diagram showing a structure of a computer system according to a third embodiment of the present invention.

As shown in FIG. 4, there are two display control register banks and three GOSs (a primary GOS 201, and a secondary GOS 202 and a second GOS 203). The primary GOS 201 and the secondary GOS 202 comprise device simulating units 2011 and 2021 respectively, and the second GOS 203 comprises a first device drive unit 2031. The virtual machine manger 100 comprises a communication unit 102.

Here, the second GOS 203 belongs to a second class of GOSs which indirectly access the graphics card through the first class of GOSs such as the primary GOS 201 or the secondary GOS 202.

In such case, the first device drive unit 2031 of the second GOS 203 and the device simulating unit 2022 (or the device simulating unit 2012) may be connected through the communication unit 102.

The device drive unit 2031 sends a command of accessing the graphics card 000 by the second GOS 203 to the device simulating unit 2022 (or the device simulating unit 2012) through the communication unit 102. The device simulating unit 2022 (or the device simulating unit 2012) simulates the graphics card for the second GOS 203, and provides accesses to the graphics card 000 for GOS 203 through the device drive unit 2021 (or the device drive unit 2011). As a result, it is possible to carry out display output for the second GOS 203 through the secondary GOS 202 (or the primary GOS 201).

The above embodiments are described in a case where the computer system comprises only one secondary GOS. Obviously, in any of the above embodiments, there may be several secondary GOSs. In such case, the graphics card memory resources allocated to the respective GOSs may be the same or different, and the display control register banks allocated to the respective GOSs may be the same or different.

Those described above are only embodiments of the present invention. It should be noted that, for those skilled in the art, there may be various modifications and improvements without departing from the principle of the invention. Such modifications and improvements fall into the scope of the present invention.

What is claimed is:

1. A method for sharing a graphics card among multiple Operation Systems (OSs), the graphics card having display control register banks and graphics card memory resources, the display control register banks having information on display mode parameters stored therein, the multiple OSs comprising a primary Guest Operation System (GOS) and at least one secondary GOS, the method comprising:

detecting that a first GOS is to be displayed;

determining whether the first GOS is the primary GOS or one of the at least one secondary GOS;

when the first GOS is determined to be the primary GOS:

allocating all the display control register banks and all graphics card memory resources of the graphics card to the first GOS;

controlling the display control register bank(s) allocated to the first GOS to connect to a display output port;

displaying the first GOS based on the graphics card memory resources allocated to the first GOS and the display mode parameters stored in the display control register bank(s) connected to the display output port, and when the first GOS is determined to be one of the at least one secondary GOS:

allocating one of the display control register banks and a part of the graphics card memory resources are allocated to the first GOS;

controlling the display control register bank(s) allocated to the first GOS to connect to a display output port;

displaying the first GOS based on the graphics card memory resources allocated to the first GOS;

and the display mode parameters stored in the display control register bank(s) connected to the display output port.

2. The method according to claim 1, wherein, when the first GOS is one of the at least one secondary GOS, the one display control register bank and the part of the graphics card memory resources are allocated to the first GOS based on requirements for a display effect of the at least one secondary GOS.

3. The method according to claim 1, the method further comprising, prior to displaying the first GOS:

saving display mode parameters in a display control register bank for a currently displayed GOS, and loading pre-stored display mode parameters for the first GOS; and saving display output setting parameters corresponding to the currently displayed GOS, and loading pre-stored display output setting parameters corresponding to the first GOS.

4. The method according to claim 3, the method further comprising, prior to displaying the first GOS:

saving a graphics card memory mapping relationship corresponding to the currently displayed GOS, and loading a pre-stored graphics card memory mapping relationship corresponding to the first GOS.

5. The method according to claim 1, further comprising:

when one of the at least one secondary GOS is being displayed in a foreground, intercepting an access by a second GOS other than the at least one secondary GOS to the graphics card memory resources or the display control register bank allocated to the at least one secondary GOS, and simulating for the second GOS the intercepted access to the graphics card.

6. The method according to claim 1, further comprising:

when one of the at least one secondary GOS is running in a background, the at least one secondary GOS does not update contents in its graphics card memory resources or the display control register bank.

7. A computer system, comprising:

a primary Guest Operation System (GOS) and at least one secondary GOS;

a virtual machine manager, in connection with the primary Guest Operation System (GOS) and the at least one secondary GOS;

a graphics card including at least two display control register banks and graphics card memory resources, the display control register banks having information on display mode parameters stored therein;

a display output port; and a switching control unit for:

detecting that a first GOS is to be displayed;

determining whether the first GOS is the primary GOS or one of the at least one secondary GOS; and when the first GOS is determined to be the primary GOS:

allocating all the display control register banks and all graphics card memory resources of the graphics card to the first GOS;

allocating one of the display control register banks and a part of the graphics card memory resources are allocated to the first GOS;

a display output unit for displaying the first GOS through the display output port based on the graphics card memory resources allocated to the first GOS.

8. The computer system according to claim 7, further comprising a selection register for controlling a first display control register bank corresponding to the first GOS to connect to the display output port.

9. The computer system according to claim 7, wherein the primary GOS and the at least one secondary GOS each have a device drive unit for saving configuration information about the display control register bank(s) and the graphics card memory resources corresponding to the pertaining GOS and for providing accesses to the graphics card for the pertaining GOS.

10. The computer system according to claim 7, wherein the switching control unit comprises a display mode loading unit and a display output setting loading unit, wherein the display mode loading unit is adapted to save display mode parameters in a display control register bank for a currently displayed GOS and load pre-stored display mode parameters for the first GOS prior to display of the first GOS; and the display output setting loading unit is adapted to save display output setting parameters corresponding to the currently displayed GOS and load pre-stored display output setting parameters corresponding to the first GOS prior to display of the first GOS.

11. The computer system according to claim 10, wherein the switching control unit further comprises a graphics card memory mapping unit for saving a mapping relationship between the graphics card memory resources and a physical memory, and the switching control unit further comprises a graphics card memory mapping loading unit for saving a current mapping relationship in the graphics card memory mapping unit and loading a pre-stored mapping relationship corresponding to the first GOS into the graphics card memory mapping unit.

12. The computer system according to claim 7, wherein the display output unit comprises a selection register and a display output port, wherein the selection register is adapted to control the first display control register bank corresponding to the first GOS to connect to the display output port.

13. The computer system according to claim 7, wherein the virtual machine manager further comprises an interception unit and the secondary GOS further comprises a device simulating unit, wherein the interception unit is adapted to intercept an access by a second GOS other than the one secondary GOS to the graphics card memory resources or the display control register bank allocated to the secondary GOS when the secondary GOS is being displayed in a foreground, and the device simulating unit is adapted to simulate for the second GOS the accesses to the graphics card.

* * * * *